US005386752A

United States Patent [19]

Siegel

[11] Patent Number: 5,386,752

[45] Date of Patent: Feb. 7, 1995

[54] PERFORATION APPARATUS AND METHOD FOR USE WITH SEALING DEVICES

[75] Inventor: Martin Siegel, Englewood Cliff, N.J.

[73] Assignee: Weldotron of Delaware, Inc., Wilmington, Del.

[21] Appl. No.: 971,720

[22] Filed: Nov. 4, 1992

[51] Int. Cl.[6] ..... B26F 1/24

[52] U.S. Cl. ..... 83/30; 83/18; 83/175; 83/660

[58] Field of Search ..... 83/660, 669, 175, 18, 83/30

[56] References Cited

U.S. PATENT DOCUMENTS

| | | | |
|---|---|---|---|
| 1,164,650 | 12/1915 | Ireland et al. | 83/175 |
| 2,160,367 | 0/1939 | Maxfield . | |
| 2,822,653 | 2/1958 | Zinn, Jr. et al. . | |
| 2,914,893 | 12/1959 | Berst . | |
| 3,007,295 | 0/1961 | Heinzer . | |
| 3,081,501 | 3/1963 | Kalwaites | 83/30 X |
| 3,224,311 | 12/1965 | Wagner | 83/175 X |
| 3,417,544 | 12/1968 | Grevich . | |
| 3,706,250 | 12/1972 | Herd | 83/660 X |
| 3,958,390 | 5/1976 | Pringle, Jr. et al. . | |
| 3,973,372 | 0/1976 | Omori . | |
| 4,035,984 | 7/1977 | Gerlach et al. . | |
| 4,041,673 | 8/1977 | Brooke et al. . | |
| 4,144,697 | 0/1979 | Suga . | |
| 4,167,131 | 9/1979 | Habas et al. | 83/660 X |
| 4,182,208 | 1/1980 | Bruno et al. | 83/175 X |
| 4,184,619 | 1/1980 | Stewart et al. | 83/660 X |
| 4,216,690 | 8/1980 | Bullock | 83/660 X |
| 4,219,988 | 0/1990 | Shanklin et al. . | |
| 4,548,024 | 10/1985 | Fine . | |
| 4,553,377 | 0/1985 | Klinkel . | |
| 4,630,429 | 12/1986 | Christine . | |
| 4,653,363 | 3/1987 | Lang | 83/30 |
| 4,658,569 | 0/1987 | Hanagata . | |
| 4,667,552 | 5/1987 | Calligarich . | |
| 4,702,133 | 10/1987 | Lang | 83/30 |
| 4,722,168 | 0/1988 | Heaney . | |
| 4,807,426 | 0/1989 | Smith . | |
| 4,872,302 | 0/1989 | Van Eijsden et al. . | |
| 4,956,963 | 0/1990 | Johnson . | |
| 5,042,229 | 8/1991 | Hirose . | |

FOREIGN PATENT DOCUMENTS

| | | | |
|---|---|---|---|
| 4210399 | 7/1992 | Japan | 83/30 |

OTHER PUBLICATIONS

"Shrink Film Perforator Units–Single Wound Web Machines" Reynolds Metals Company, Flexible Packaging Division, dated Oct. 30, 1992.

*Primary Examiner*—Rinaldi I. Rada

*Attorney, Agent, or Firm*—Davis Hoxie Faithfull & Hapgood

[57] ABSTRACT

A perforating device for punching pores in shrink-wrap film as the film moves along a film path is described. A biasing apparatus is used to bias the film towards a tension-creating apparatus and a microperforator apparatus so that pores can be punched in the film. An embodiment of the invention uses microperforator pin wheels, having a plurality of conically-shaped pins, and gripper wheels connected to a microperforator shaft. A rotary brush is connected to a rotary brush shaft. Shrink-wrap film is threaded between the microperforator shaft and the rotary brush shaft, and then pulled by an operator to wrap a package. The rotary brush biases the film towards the microperforator pin wheels and the gripper wheels, so that the pins on the micoperforator pin wheels puncture the film as it is being pulled. The rotary brush shaft can be adjusted to permit film to be threaded, and to control the size of the pores to be punched into the film. In addition, the amount and location of the microperforator pin wheels and the gripper wheels connected to the microperforator shaft can be changed so that the device can be customized to provide different patterns of pores as well as to control the amount of pores to be punched.

17 Claims, 9 Drawing Sheets

PERFORATION APPARATUS AND METHOD FOR USE WITH SEALING DEVICES

FIELD OF THE INVENTION

The present invention relates to the art of heat-shrink packaging devices such as L-sealers, hermetic sealers and the like. In particular, the present invention is an apparatus and method for making pores in shrink-wrap used to wrap items in a heat-shrink-wrapping system.

BACKGROUND OF THE INVENTION

In recent years, it has become increasingly popular and commonplace to package many commercial articles in close-fitting transparent film. The transparent film is commonly known as shrink-wrap and has a characteristic of shrinking to conform to the item when exposed to heat.

Shrink packaging is a process in which an item is loosely wrapped in a shrink film and subjected to controlled heat by passing the package through a heat-shrink tunnel. The shrink films are typically supplied on rolls and are usually comprised of either polyolefins, PVC or polyethylene, each of which has the characteristic of having been stretched as part of the film production process.

Shrink films are designed to shrink when exposed to heat and will conform tightly around a product after the shrinking process. However, air which is trapped within the package during the sealing process must be permitted to escape at the proper rate during the shrinking process or else the shrink film will not shrink properly. Failure to provide adequate ventilation can result in a "ballooning effect" which occurs when all the air cannot escape during shrinking. Excessive ballooning can cause the shrink film to tear, cause the shrink film to wrinkle as air gradually and unevenly escapes, or create "dog ears" where the corners of the package are located. However, some ballooning is required because, if the film shrinks too quickly, it contacts the relatively cold item at points before shrinking is complete which may produce wrinkling. The packaging industry requires shrink-wrapped packages to be tightly wrapped without any tears and a minimum of wrinkling, since a consumer is less likely to buy an item which appears to be poorly wrapped. Consequently, it is highly desirable that heat-shrink film be perforated to permit exhaust at the proper rate.

To permit exhaust of the air that is trapped inside the package during the shrinking process, at least one vent hole is provided. Prior art shrink-wrapping systems added such vent holes to the shrink film by one or more of a variety of methods, including punching the film with an electric or pneumatic punching die, or creating a hole by using an electric arc, a hole burner or a rotary pin perforator. The vent holes created in these ways were usually relatively large in size.

One problem experienced by the prior art shrink-wrapping systems concerned the positioning of the vent hole. If the vent hole was located such that trapped air could not escape fast enough, the excessive ballooning effect discussed above occurred. Further, air could become trapped between the edges of the item and the shrinking film. If the hole was not located in that section of film, the trapped air might cause the film seal to burst or cause the film to tear. Further, the relatively large hole needed to permit entrapped air to escape during the shrinking process often appeared unsightly in the finished product. In addition, because of the large size of the hole, a possibility of future contamination of the package existed, especially with respect to shrink-wrapped food products. Yet further, the vent hole sometimes induced tearing of the shrink film which destroyed the wrapping around the package because all of the trapped air was forced out of a few holes.

To reduce some of these difficulties, the temperature in the heat shrink tunnel was often increased. Although increasing the temperature reduced the wrinkling and dog ear problems to some extent, it also increased the amount of tears in the film. Such over-heating or "burn out" increases the reject ratio of packages and thus raises costs. Further, the heat tunnel requires more energy to operate at a higher temperature.

Some film manufacturers provide film rolls having vent holes that are created in the film during a post production process. This film is designed for wrapping items that need to "breathe" such as crusty breads, leafy food products, and the like, and are generally not used for shrink-wrapping. These vent holes are produced using hot perforators and are relatively large and visible. Further, a roll of such film containing the vent holes is significantly more expensive than a plain roll of shrink-wrap film.

Other problems associated with existing sealing apparatuses include wasted film remaining from the punched holes, and the requirement of a distinct power source, which increases costs and maintenance.

SUMMARY OF THE INVENTION

It is, therefore, an object of the present invention to provide a method and apparatus for providing pores in shrink-wrap through an in-line, on board-system to overcome the short-comings associated with the prior art shrink-wrapping systems.

It is a further object of the present invention to provide a method and apparatus for providing a vast number of minute pores in the shrink-wrap film.

It is a further object of the present invention to provide a method and apparatus for creating pores in a shrink-wrap film which prevents tearing of the film during the shrink-wrap process, and which prevents the subsequent contamination of the package.

It is a further object of the invention to provide an apparatus which can be easily adjusted to vary the position and control the size of the pores.

It is a further object of the present invention to provide a method and apparatus for controlling the rate at which the entrapped air bleeds out of the shrink-wrapped package.

It is a further object of the present invention to provide adequate venting of a package during the heat-shrink process without using any large vent holes.

It is a further object of the present invention to provide a method and apparatus for creating pores in a shrink-wrap film in line with the film path of a wrapping device.

It is a further object of the present invention to provide a method and apparatus which reduce wrinkling in shrink-wrapped packages while decreasing the temperature in the heat shrink tunnel.

It is a further object of the present invention to provide an on-board perforating device for shrink-wrapping machines that does not require a separate power source.

It is a further object of the present invention to provide a venting system that produces a vast number of minute pores in shrink film that are virtually invisible and yet exist along the entire surface of the film to permit uniform air flow from within the package.

In accordance with a first aspect of the present invention, a perforating device is provided for punching pores in shrink-wrap film as it moves along a film path. One embodiment employs a means for creating tension on the film as it passes a microperforator apparatus which is located opposite a rotary brush. The rotary brush biases the film towards the microperforator apparatus which contain a plurality of pins that punch a vast number of minute pores in the film. The microperforating device can be retrofit to existing shrink-wrap film packaging systems, or be fitted to new shrink-wrapping systems. It is designed to be used with shrink-wrapping systems as an in-line, on-board perforating apparatus.

In accordance with a second aspect of the invention, an adjustment apparatus is provided to permit an operator to easily adjust the size of the pores. The rotary brush is preferably adjusted to move closer to the microperforator apparatus if larger pores are to be punched, or moved away from the microperforator apparatus so that smaller holes can be punched. Thus, an operator can control the size of the pores which is the same as controlling the rate at which entrapped air bleeds out of the package. Thus, the temperature of the heat tunnel can be reduced if larger holes are punched.

In accordance with a further aspect of the present invention, the microperforator apparatus comprises a plurality of microperforator pin wheels and gripper wheels on a shaft which can be positioned to produce predetermined patterns of pores on the shrink-wrap film. An operator can use different combinations of microperforator pin wheels and gripper wheels. Thus, the perforator apparatus can be customized to conform to operator requirements regarding the amount and position of pores to be punched. Small pores are virtually invisible on the finished, shrink-wrapped package, and if enough small pores are used then the operating temperature of the heat tunnel can be reduced.

BRIEF DESCRIPTION OF THE DRAWINGS

These and other objects, aspects and embodiments of the present invention will be described with reference to the following drawings, of which.

DETAILED DESCRIPTION

The present invention will be described in conjunction with a semi-automatic L-sealer system 1 shown in FIGS. 1A and 1B, but it will be appreciated that the present invention can be used with other sealing apparatuses as well, such as horizontal form fill wrappers or edge seal wrappers.

Figure 1A:
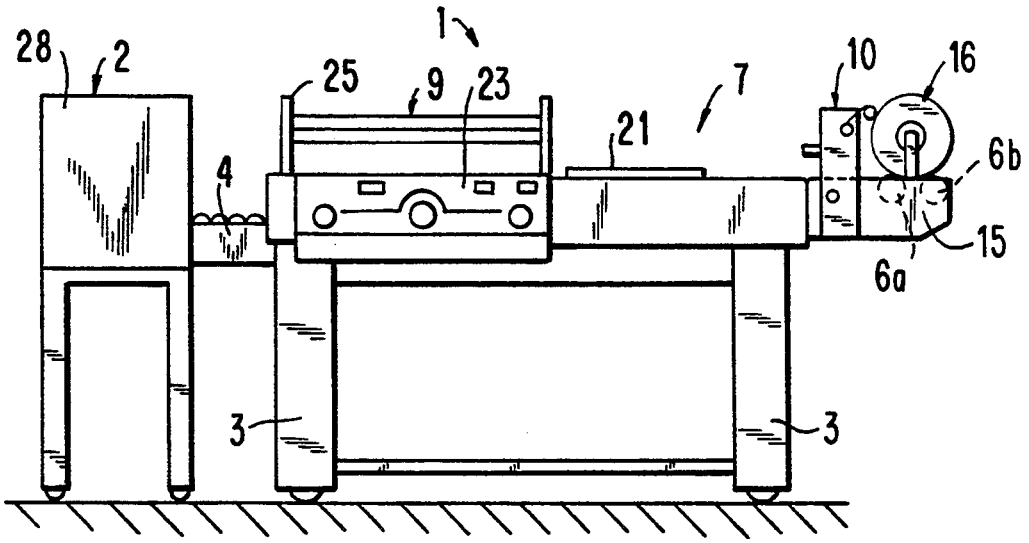
FIGS. 1A and 1B are a perspective and a top view, not drawn to scale, of a heat-sealing system employing a perforator apparatus according to the present invention.

FIG. 1A is a front view, from the perspective of an operator, of a semi-automatic sealing machine 1 supported by legs 3, and having a film dispenser 15, a packaging area 7, a sealing area 9, a conveyor 4, and a heat shrinking area 2. FIG. 1B is a top view of the sealing machine of FIG. 1A.

Figure 1B:
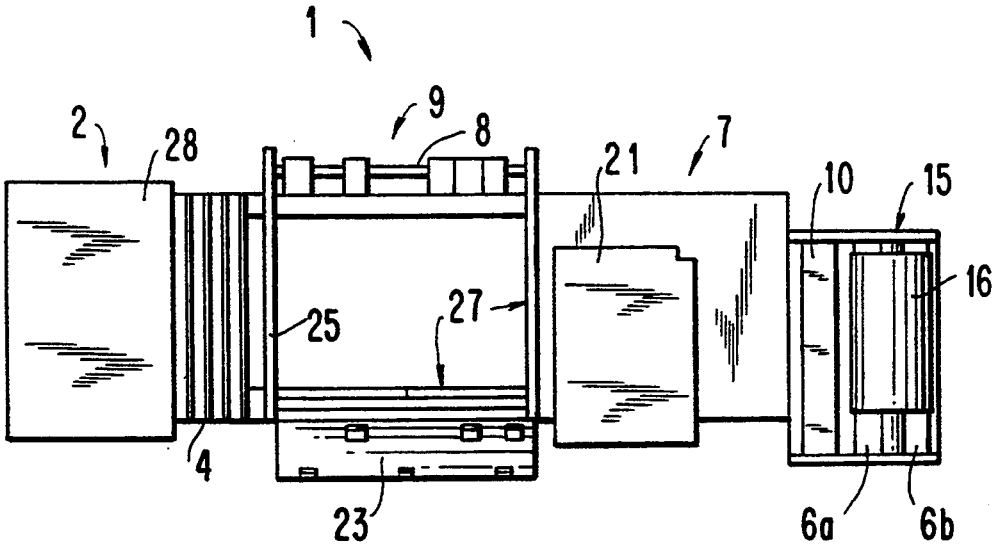

As shown in FIGS. 1A and 1B, the film 17 proceeds from right to left, i.e., upstream to downstream. The film dispenser 15 accommodates a roll 16 of pre-folded film 17 (see FIG. 2A) on rollers **6*a* and 6*a*. The film 17 is oriented such that its fold is disposed toward the rear as it approaches the packaging area 7 (i.e., to the top of FIG. 1B). A microperforator apparatus 10 according to the present invention is shown situated in between the film dispenser 15 and the packaging area 7. A separator 19 (shown in FIG. 2A), which separates the film 17, is situated directly downstream of the microperforator apparatus 10. An item to be wrapped is placed on a feeding plate 21, located in the packaging area 7**.

The sealing area 9 contains a U-shaped member 25 which is mounted at the rear of the sealing area 9 on a pivot bar 8, which is pivotally secured at its ends to the L-sealer apparatus. An upper L-shaped seal bar 27 is mounted on the front and to the right side of the U-shaped member 25, and a lower L-shaped seal bar (not shown) is mounted on the surface of the sealing area 9. The lower seal bar comes into substantially direct, continuous and uniform contact with the upper seal bar 27 when the latter is in sealing position. Items to be sealed are moved from the feeding plate 21 to the sealing area 9 where an operator uses the L-sealer to seal the loose flaps of the shrink-wrapped item. Packages which have been sealed are then moved along a conveyor 4 to a heat tunnel 28 for heat-shrinking.

In order to understand the utility of the present invention, a brief description of the entire packaging process follows. An operator first loads a roll of shrink-wrap film 16 on the film dispenser 15, and then threads the film 17 through the microperforator apparatus 10. (Details concerning the threading of film 17 through the microperforator apparatus, and the components contained therein are explained in detail below.) The operator then pulls the film 17 downstream. The separator 19 causes the layers of folded film to separate. The top layer of film is disposed above the feeding plate 21, and the bottom layer of film is disposed below the feeding plate 21. The operator inserts an item to be wrapped between the layers of film by sliding it on the feeding plate beneath the top layer of film. As the film 17 is pulled downstream, it moves through the microperforator apparatus 10 where pores are punched in the film 17 by microperforator pin wheels 36 (shown in FIG. 2B). In the presently preferred embodiment, about 1000 pores are punched in a section of film that is 12 inches square. A preferred embodiment of a microperforator apparatus 10 according to the present invention punches pores without requiring a separate source of power, and does not use heat to melt or otherwise penetrate the film 17.

After loosely wrapping the item in shrink-wrap film 17, the operator moves the package to the sealing area 9 and pushes U-shaped member 25 down, causing the upper seal bar and lower seal bar to engage, to seal and cut the film 17 around the item. The controls found on the console 23 may be used to control the operation of L-sealer apparatus to seal the package. The package is then transported, typically by an automatic conveyor 4, to the heat tunnel 28. (Any one of the preceding steps, or all of them, may be performed either manually, semi-automatically or automatically.) Once inside the heat tunnel, the package is heated, and trapped air escapes through the pores punched in the film 17 by the microperforator apparatus 10 as the film 17 shrinks to conform to the item. The package stays in the heat tunnel 28 long enough at a sufficient temperature to shrink the film 17 to form a tightly wrapped package. Because of the large number of pores punched by the present invention, and their placement across the entire surface of the film, the heat shrink tunnel can operate properly at a lower temperature, thus saving energy.

Details concerning the operation of L-sealers do not form a part of the present invention and will not be discussed further herein. Further, the invention could be used with other types of sealers such as horizontal form-fill wrappers or edge seal wrappers.

Figure 2A:
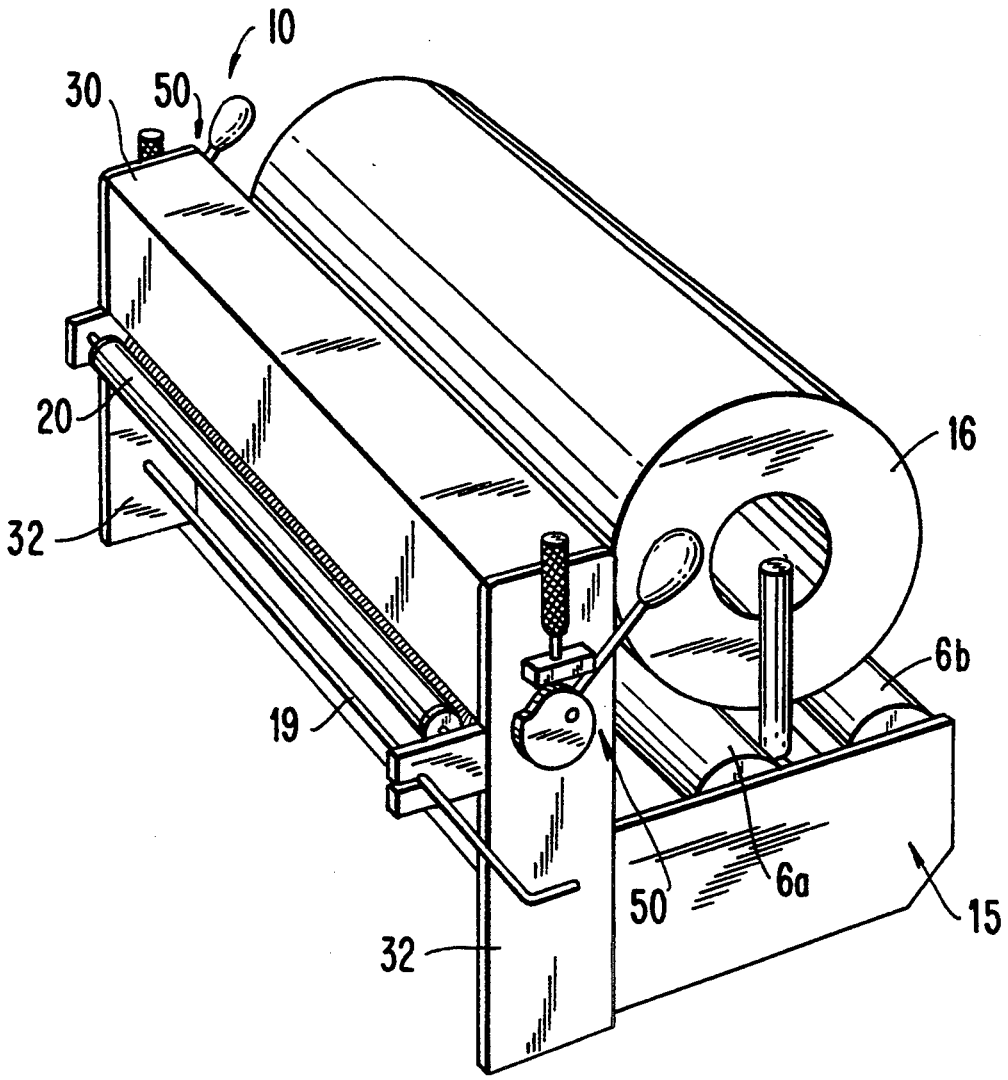
FIGS. 2A and 2B are perspective views of an embodiment of a perforator apparatus according to the present invention.

FIG. 2A is a perspective view of a microperforator apparatus 10 according to the present invention shown connected to a film dispenser 15. The microperforator apparatus 10 can be easily retrofit to existing sealing apparatuses, or can be sold as a component of a new machine. The apparatus 10 has a safety cover 30, preferably made of a transparent plastic material, attached to two housing elements 32. The safety cover prevents injury from occurring due to contact with the microperforator pin wheels 36 (see FIG. 2B) which contain sharp conically-shaped pins that function to punch pores in the film 17. The housing elements 32 support a film separator rod 19, a film guide roller 20, and dual microperforator adjustment assemblies 50.

Figure 2B:
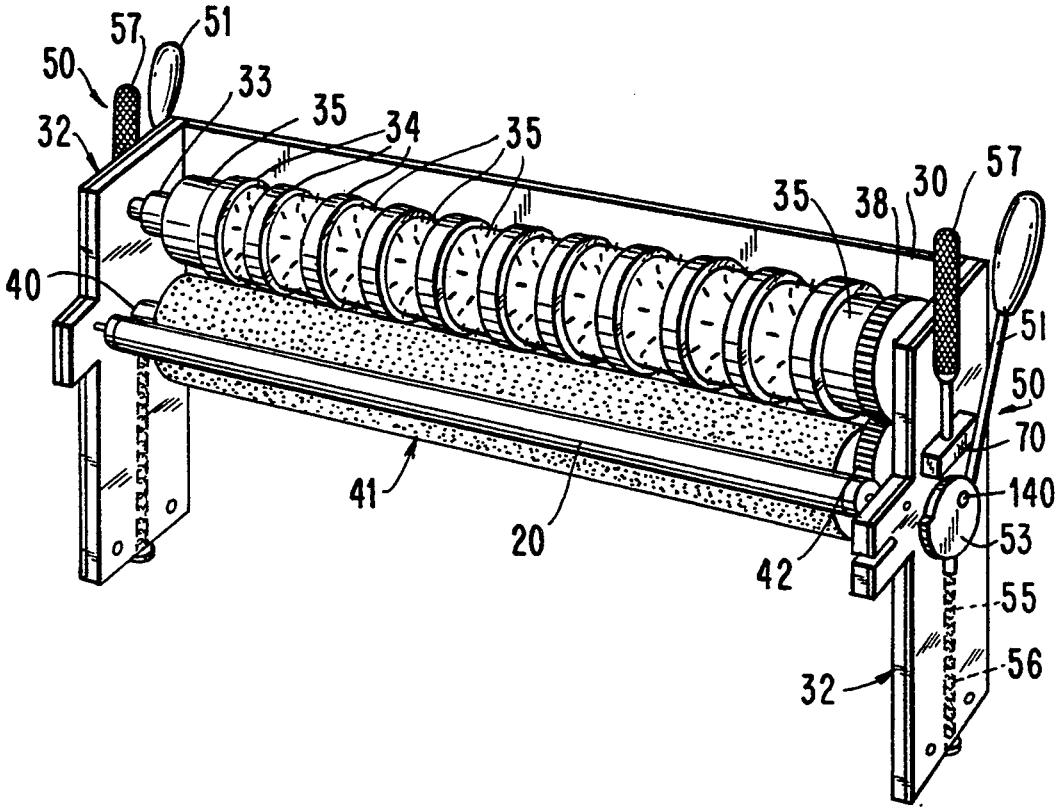

FIG. 2B is a detailed perspective view of the microperforator apparatus 10 of FIG. 2A. A microperforator shaft 33 and a rotary brush shaft 40 are shown mounted between the housings 32. Connected to the microperforator shaft 33 are a plurality of gripper wheels 34, spacer wheels 35, and microperforator pin wheels 36. Also connected to the microperforator shaft 33 is a first drive gear 38. A rotary brush 41, preferably comprised of high-density nylon bristles, is connected to the rotary brush shaft 40 along with a second drive gear 42. While the brush 41 is preferably comprised of high-density nylon bristles, the brush-could be any stiff material or any roller with a pliable surface, such as polyurethane or a high pile cloth or felt.

FIG. 2B also depicts two microperforator adjustment assemblies 50 which are mounted to the housing elements 32. Each assembly 50 comprises a cam lifter lever 51, a cam lift 53, spring rods 55, a knob holder 70 and a micro-adjustment knob 57. The cam lifts 53 are rotatably mounted to each end of the rotary brush shaft 40. The micro-adjustment knobs 57 are connected to knob holders 70, and the spring rods 55 are located inside a channel 56 which runs through the housings 32.

Figure 3:
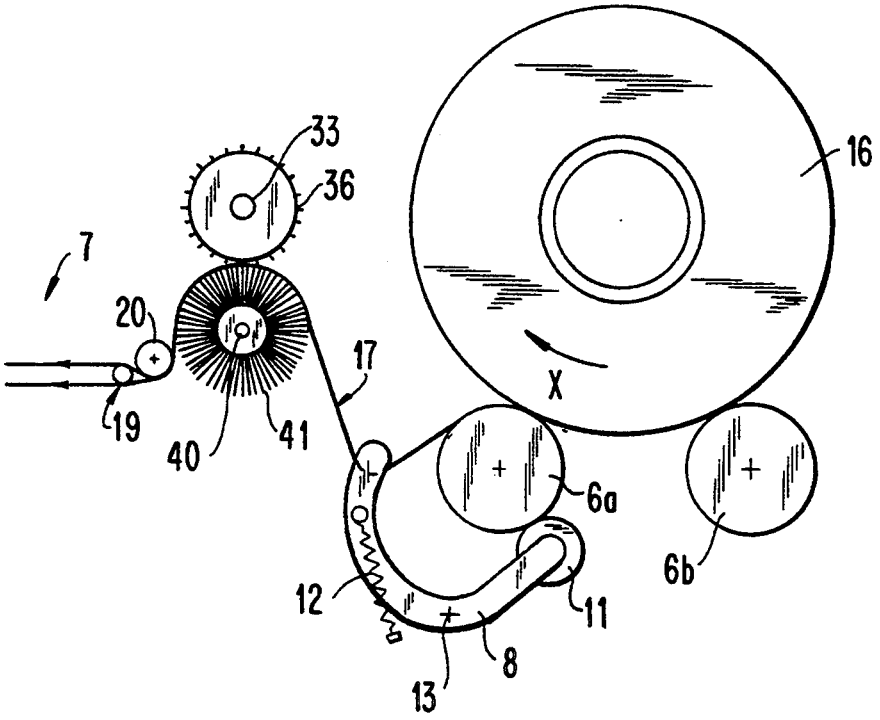
FIG. 3 is a threading diagram of the perforator apparatus of FIGS. 2A and 2B.

FIG. 3 is a threading diagram depicting how the film 17 moves through the microperforator apparatus 10. A roll of pre-folded film 16 is rotatably mounted to the film dispenser 15. Rollers **6*a* and 6*b* maintain the film on the roller 16, guiding it toward the microperforator apparatus 10. The roller 16 turns in a clockwise direction indicated by arrow "X". The film 17 is fed under a hook brake 8. When the film is not being pulled, a spring 12 acts to pivot the hook brake 8 counterclockwise about pivot point 13 so that a rubber stop 11 engages roller 6*a*, preventing feeding of the film. When the operator pulls the film, film tension causes the hook brake 8 to overcome the bias of spring 12 and to rotate clockwise about the pivot point 13. The rubber stop 11 then disengages from roller 6*a***, permitting dispensing of the film.

Referring to FIG. 3, a microperforator pin wheel 36 and the rotary brush 41 are shown in cross-section with the film 17 threaded between them. The film 17 proceeds under film guide roller 20, around separator 19, and then on to the packaging area 7. As an operator pulls the film, the film roll 16 turns and film 17 is fed through the microperforator apparatus 10, and microperforator pin wheel 36 punches pores in the film 17.

Figure 4:
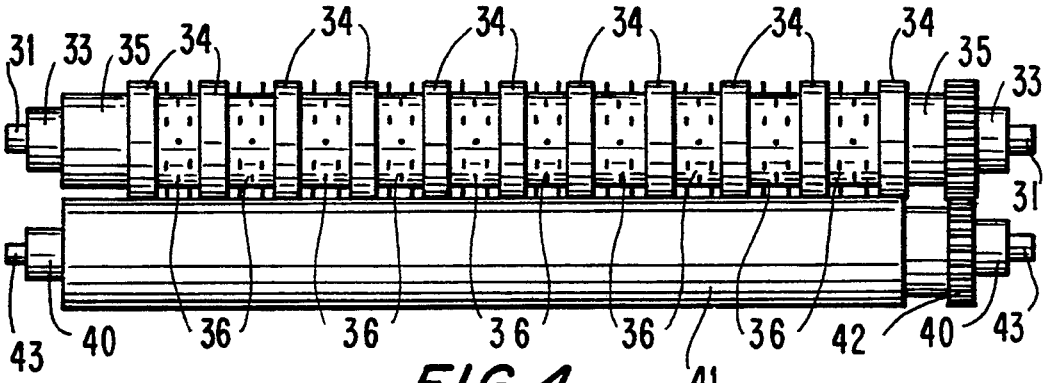
FIG. 4 is a front, detailed view of a perforator shaft component and a rotary brush component.

FIG. 4 is a front, detailed view of the microperforator shaft 33 and rotary brush shaft 40 components of the microperforator apparatus 10. The microperforator shaft 33 has an inner shaft 31, and the rotary brush shaft 40 has a rotary inner shaft 43 for connection to the housings 32 (see FIGS. 2A and 2B). The microperforator shaft 33 may have a "D" shaped cross section, or have a flattened portion running the length of the shaft, so that the microperforator pin wheels 36 and gripper wheels 34 can be fixidly attached. Alternately, the microperforator shaft 33 may have a key way such that the gripper wheels and microperforator pin wheels are fixed to and rotate with the shaft. The first drive gear 38 is fixidly attached to the microperforator shaft 33, and meshes with the second drive gear 42 which is fixidly attached to the rotary brush shaft 40.

An arrangement of microperforator pin wheels 36, gripper wheels 34, and spacer wheels 35 is shown connected to the microperforator shaft 33. The pattern of having a spacer wheel 35, and then a series of alternating gripper wheels 34 and microperforator pin wheels 36, may be altered depending on customer requirements or on application specific needs. For example, two gripper wheels 34 may be placed side by side between two or more microperforator pin wheels 36, or a plurality of microperforator pin wheels 36 could be used with only a few gripper wheels 34. In addition, microperforator pin wheels 36 having different pin densities (see discussion below regarding FIGS. 8A–8C) could be used in the same microperforator pin apparatus 10.

FIGS. 5A–D are side views of a gripper wheel 34, a spacer wheel 35, a microperforator pin wheel 36, and a rotary brush 41, respectively. The gripper wheel 34, spacer wheel 35 and microperforator pin wheel 36 are all designed to fit onto microperforator shaft 33. The microperforator shaft 33 may have a flattened portion to permit one or all of the microperforator pin wheels 36, gripper wheels 34, and spacer wheels 35 to be fixidly attached. For example, the microperforator pin wheels 36 may be fitted with set screws designed to contact the flat portion of the shaft 33. The rotary brush 41 is fixedly mounted on the rotary brush shaft 40.

Figure 5A:
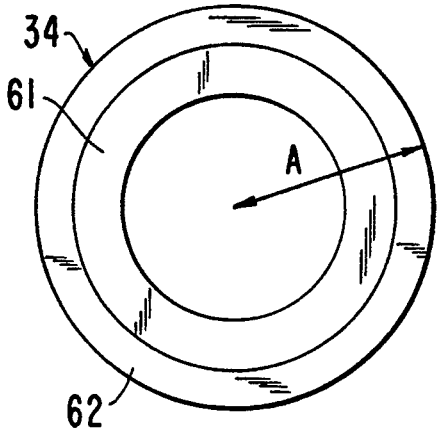
FIGS. 5A, 5B, 5C and 5D are side views of a gripper wheel, a spacer wheel, a perforator pin wheel, and a rotary brush, respectively.
Figure 5B:
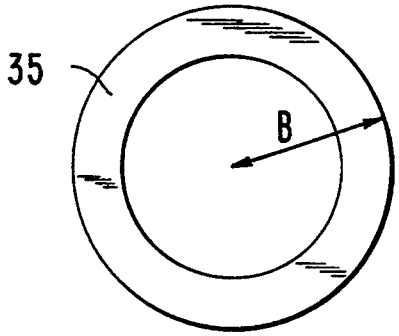
Figure 5C:
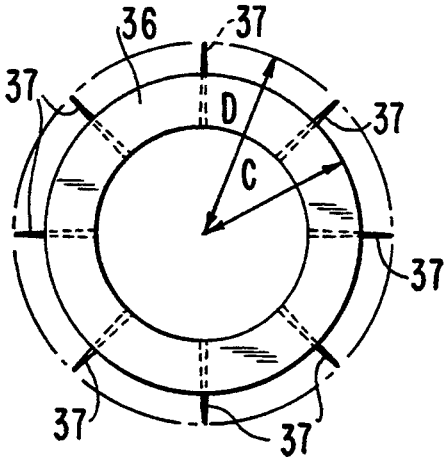
Figure 5D:
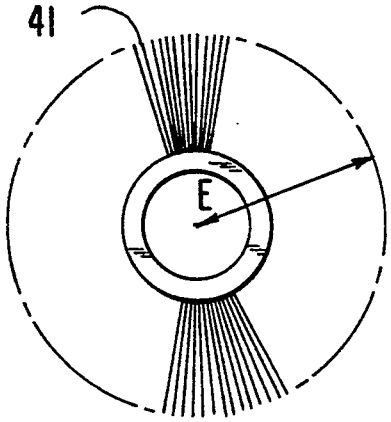
Figure 5E:
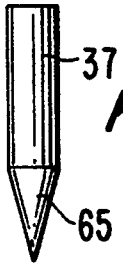
FIG. 5E is a detailed view of a perforator pin.

FIG. 5E depicts details of a pin 37 of a type that would be fitted into pre-drilled holes on the microperforator pin wheel 36 of FIG. 5C. It is important to note that the pin 37 has a sharp conical tip 65. The conical shape of the pin 37 is one factor which permits an operator to adjust the microperforator apparatus 10 to produce pores of different sizes. Although pins 37 do not have to be machined to exact tolerances for the present invention to function properly, if required, sets of identically machined pins can be inserted into the microperforator pin wheel 36 so that exactly the same size holes will be produced for a given setting of the microperforator apparatus 10.

Referring to FIG. 5A, the gripper wheel 34 has a radius distance "A". Gripper wheel 34 is comprised of an inner wheel 61, preferably composed of a metal such as aluminum, and an outer gripper wheel 62, preferably composed of PVC material or the like. FIG. 5B depicts a spacer wheel 35 preferably comprised of aluminum having a radius distance "B". FIG. 5C shows a microperforator pin wheel 36, preferably made of aluminum, having a radius distance "C", and which contains a plurality of pins 37. The radius distance "D" equals the distance from the center of the microperforator pin wheel 36 to the tip of any one of the pins 37. Lastly, FIG. 5D depicts a rotary brush 41 having a radius distance "E".

In order for holes to be correctly punched in the film 17, the radius distance "A" of gripper 34 should be greater than the radius distance "C" of microperforator pin wheel 36, and the same or greater than the radius distance "D". This is important because when a sheet of film 17 is fed between the microperforator shaft 33 and the rotary brush shaft 40 as shown in FIG. 3, the film 17 is biased towards the gripper wheels 34 and the microperforator pin wheels 36 by the bristles of rotary brush 41. The gripper wheels 34 act with the bristles of the brush 41 to provide a lateral tension in the film between adjacent gripper wheels so that the conically-shaped pins 37 on the microperforator pin wheels 36 can easily penetrate the film 17 and push into the voids between bristles of the rotary brush 41. Thus, the combination of the bristles of the rotary brush 41 and the rubber gripper wheels 34 combine to "freeze" the film 17 between them in the lateral direction as the film is pulled through the microperforator apparatus 10, which allows the pins 37 to punch pores in the film 17. The distance between the bristles of the rotary brush 41 and the microperforator pin wheels 36 determines the size of the holes.

Care must be taken to ensure that there is an adequate number of gripper wheels 34 properly spaced across the microperforator shaft 33 so that the film 17 is gripped under tension along its entire lateral length between the gripper wheels and the rotary brush so that tearing problems are avoided. When film is held too loosely, the pins of the microperforator pin wheels 36 push the film, rather than puncturing it. This causes the film to run and may result in tearing. When the film is held in proper tension between the gripper wheels 34 and the rotary brush 41, the microperforator pin wheels 36 can punch pores in the film without tearing it. Further, because the pins prick many small pores, there is no waste film left loose on a workroom floor.

Figure 6A:
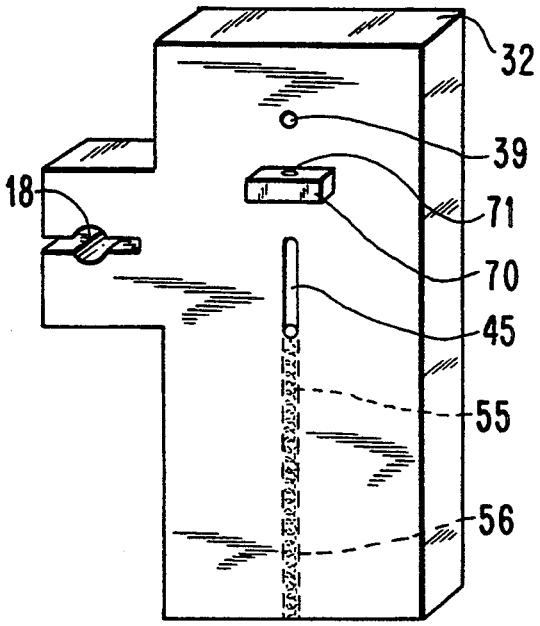
FIG. 6A is a side perspective view of a housing.
Figure 6B:
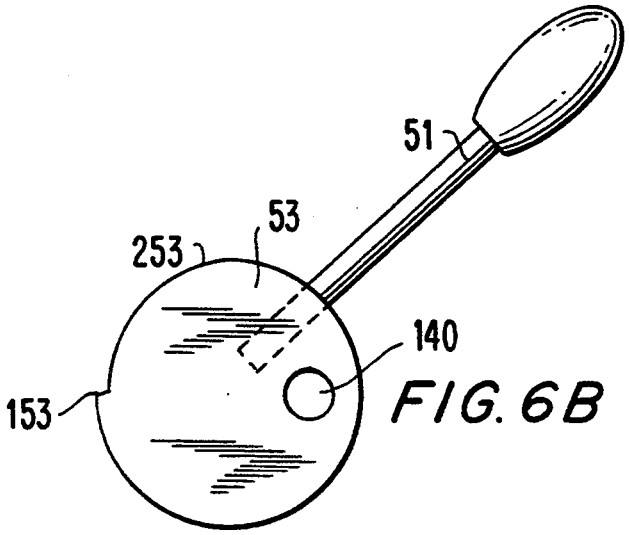
FIG. 6B is a side view of a cam lift lever apparatus.

FIG. 6A is a side view of one of the housings 32 in isolation showing a separator slot 18, a shaft hole 39, an oblong slot 45, a spring rod 55 inside a channel 56, and a knob holder 70 having threaded slot 71. Referring to FIGS. 4 and 6A, one side of the microperforator inner shaft 31 fits into shaft hole 39, and one side of the rotary inner shaft 43 of the rotary brush shaft 40 fits through oblong slot 45. The cam lifter 53, shown in FIGS. 2B and 6B, is pivotally mounted to the end of brush shaft 40 about shaft hole 140. Thus, the rotary brush shaft 40 has a range of positions defined by the oblong slot 45.

Figure 6C:
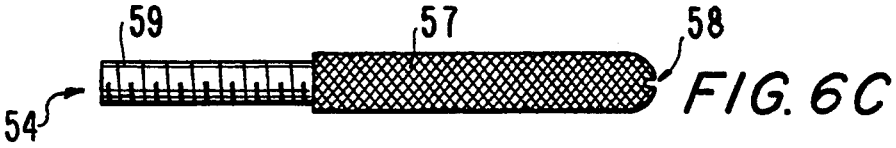
FIG. 6C is a side view of a microadjustment knob.

FIG. 6B is a side view of the cam lift lever 51 connected to the cam lift 53, and FIG. 6C is a side view of the microadjustment knob 57. These components are fitted on each housing 32 to form the dual microperforator adjustment assemblies 50 of FIG. 2B. (The cam lift 53 is drawn to exaggerate its shape so that its function can be more easily explained.)

The microadjustment knob 57 of FIG. 6C has threads 59 and a screwdriver adjustment slot 58. The threads 59 of the microadjustment knob 57 fit into the threaded slot 71 of knob holder 70 on housing 32 shown in FIG. 6A. The end 54 of the microadjustment knob 57 protrudes from the bottom of knob holder 70 and contacts the cam lift 53 to set a limit on movement of the cam lift 53. Thus, an operator can use a screwdriver in slot 58 of each microadjustment knob 57 to adjust the positioning of the rotary brush 41.

When all components of the microperforator apparatus are connected as shown in FIG. 2B, the rotary brush shaft 40 is biased in an up position by spring rod 55 which rides in channel 56. A cam lift 53 and a cam lift lever 51 are connected to each side of the rotary inner shaft 43 (shown in FIG. 4). An operator turns the cam lift lever 51 and the microadjustment knob 57 to adjust the distance between the bristles of the rotary brush 41 and the microperforator pin wheels 36.

The microperforator adjustment assemblies 50 serve two functions. The first involves threading the film, and the second involves controlling the size of the holes punched. Referring to FIG. 3, the microperforator apparatus 10 is shown in the threaded position, i.e., the film 17 is positioned between the rotary brush 41 and the gripper wheels 34. To thread the film 17 initially, the rotary brush 41 is displaced down, away from the gripper wheels 34, by rotating the cam lift lever 51. This causes the cam surface 153 to engage the end 54 of the microadjustment knob 57. As the cam lift 53 is rotated, brush hole 140 is moved down, pushing that end of the rotary brush shaft 40 down also. When both cam lift levers 51 are rotated down, the rotary brush 41 is removed from the gripper wheels 34, creating room for film threading.

The microperforator adjustment assemblies 50 could be mounted so that the microperforator shaft 33 is displaced upwards but this would require a larger safety cover 30. The microperforator could also be mounted under the brush 41, but this would increase the operator's exposure to the pins 37.

To adjust the size of the pores to be punched into the film 17, microadjustment knob 57 is rotated to change the position of the end 54. Referring to FIGS. 2B and 6A, the spring rod 55 pushes the rotary brush shaft 40 up in slot 45. This results in cam lifter 53 also being pushed up. The brush shaft 40 is prevented from reaching the top of slot 45 because the cam lifter 53 engages the end 54 of microadjustment knob 57. When the end 54 is lowered, the cam lifter 53 engages the end 54 at a lower position thus lowering the rotary brush 41.

This lowering effect is increased because rotation of the cam lifter 53, which is rotatably mounted to the shaft 40, is reduced. As the cam lifter 53 is pushed up at shaft hole 140, it is simultaneously pushed down by microadjustment knob 57 at contact point 253, resulting in rotation of the cam lifter 53. The rotation of the cam lifter 53 ceases when cam lifter lever 51 engages knob holder 70. When the end 54 is lowered, the upward movement of the cam lifter is reduced and greater rotation of the cam lifter lever 51 toward the vertical is permitted. The radius of the cam lifter 53 at point 253 increases as the cam lifter lever 51 rotates toward the vertical. This further limits the upward movement of shaft hole 140, and thus shaft 40. Alternately, moving the end 54 to a higher position increases the height of cam lifter 53 as well as reduces the rotation of the cam lifter lever 51, resulting in the brush being closer to the microperforator shaft 33.

Figure 7A:
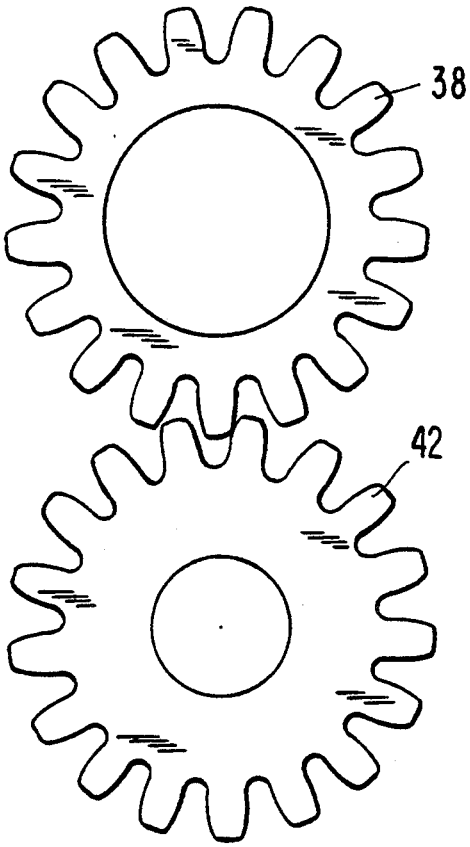
FIGS. 7A and 7B are side views of a first and a second drive gear in the open and close positions, respectively.
Figure 7B:
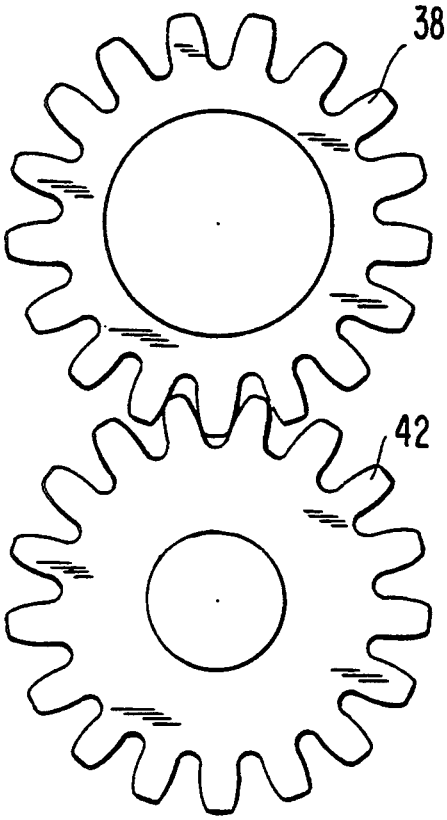

FIGS. 7A and 7B are side views of the first drive gear 38 and second drive gear 42 (shown in FIG. 4) in their fully open and fully close positions, respectively. The drive gears 38 and 42 mesh together in operation to ensure that the rotary brush shaft 40 and microperforator shaft 33 turn in unison. Other gearing type arrangements, such as the use of tapered friction wheels or a polychord belt arrangement, could be used.

FIG. 7A depicts the case in which the rotary shaft 40 was adjusted for operation to be furthest away from the microperforator shaft 33 so that the pins 37 of the microperforator pin wheels 36 will not penetrate too deeply into the film 17. Thus, very small vent holes, or pores will be punched in a sheet of film 17. FIG. 7B, however, depicts the case in which the rotary shaft 40 and microperforator shaft 33 are closest together so that the pins 37 will penetrate deeply into the film 17. Thus, larger pores will result. In general, small vent holes or pores are preferable since the smaller the hole the less visible it will be on the finished, shrink-wrapped package.

The microperforator pin wheels 36 are designed to produce very precise patterns of vent holes or pores in a sheet of film 17. Further, the pattern of pores can be easily changed by adding or subtracting gripper wheels 34 and microperforator pin wheels 36 to the microperforator shaft 33. This is advantageous since it may be required to wrap different packages of varying size and shape which may require pores in different locations. Further, if holes are positioned only on some sides of the item, the trapped air on the other sides may burst the film seal or tear the film. Thus, an operator of a heat-sealing machine utilizing a microperforator apparatus 10 according to the present invention can adjust the placement of microperforator pin wheels 36 to produce sufficient pores that will provide adequate venting of trapped air during the film shrinking process. Thus, the operator can control the rate at which entrapped air will bleed out of the package during the heat shrink process. This will result in an energy savings if the heat tunnel temperature can be reduced.

Further, the operator can customize the placement of the vent holes dependent on the item type to be wrapped so that the end product, the heat-sealed package, is presentable. Particularly, the present invention permits vent holes to be punched along the entire film, thus permitting even air flow over the entire package.

Figure 8A:
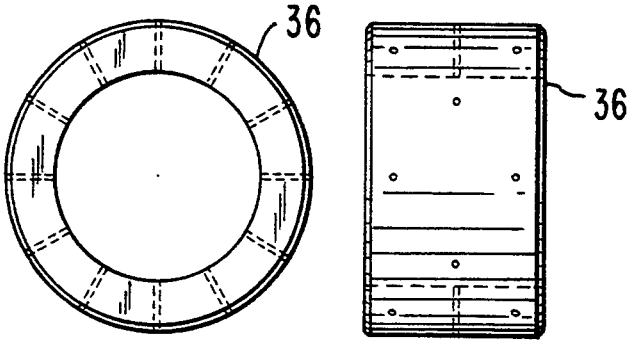
FIGS. 8A, 8B and 8C are front and side views of a low density, standard, and a high density perforator pin wheel, respectively.
Figure 8B:
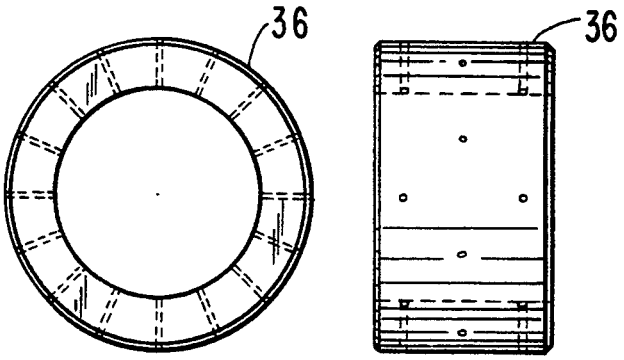
Figure 8C:
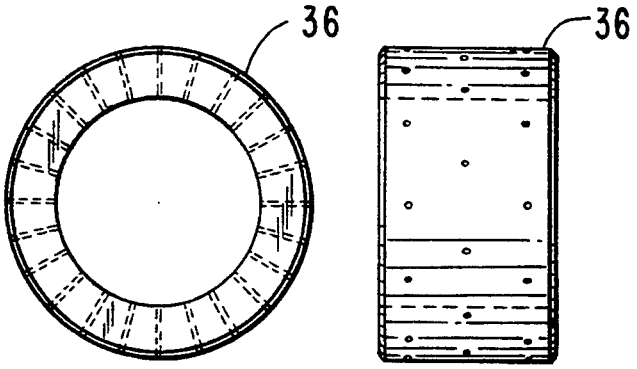

FIGS. 8A to 8C are front and side views depicting different pin configurations for a microperforator pin wheel 36. FIG. 8A shows a low-density microperforator pin wheel 36 having three rows of pins 37 of six pins each, for a total of eighteen pins. FIG. 8B shows a standard microperforator pin wheel 36 having three rows of pins of eight pins each, for a total of twenty-four pins. Lastly, FIG. 8C shows a high-density microperforator pin wheel 36 having three rows of pins of twelve pins each for a total of thirty-six pins. Of course, more or less pins may be present, and the microperforator pin wheel 36 may be manufactured to be wider to accommodate more pins, or narrower to accommodate less pins. In addition, it is preferable to set the pins 37 into the microperforator pin wheels 36 in a diamond pattern to ensure an equal distribution of punched holes, and to reduce stresses which could occur while pores are being punched that could lead to tearing of the film 17. More or less pins may be attached to a microperforator pin wheel based on customer preference or application, and other pin pattern settings could be used as well.

As described above, the present invention permits an operator to adjust the size of the pores to be punched through the film 17. This flexibility is desirable for a number of reasons. First, the size of the vent holes must be adequate so that air trapped during the sealing process can escape during the shrinking process. Second, the rate at which entrapped air escapes from the package is proportional to the size and number of vent holes available. Third, vent holes which are the wrong size can result in tearing during the film shrinking process resulting in a torn package. Fourth, vent holes which are too small do not permit adequate venting which can result in a torn or wrinkled package. If any of the above problems occur, then the package either must be rewrapped or discarded which wastes time, materials and money. Since the packaging industry requires a tightly shrink-wrapped finished product that contains a minimum of wrinkles and is not torn, it is highly desirable to be able to control the amount and size of the vent holes so that the shrink-wrapped package appears desirable to consumers.

Further, vent holes which are small in size help prevent contamination of the item within the finished package. For example, small vent holes in shrink-wrapped food items can help prevent insects, dust, and other debris from gaining entry to the package.

Figure 9:
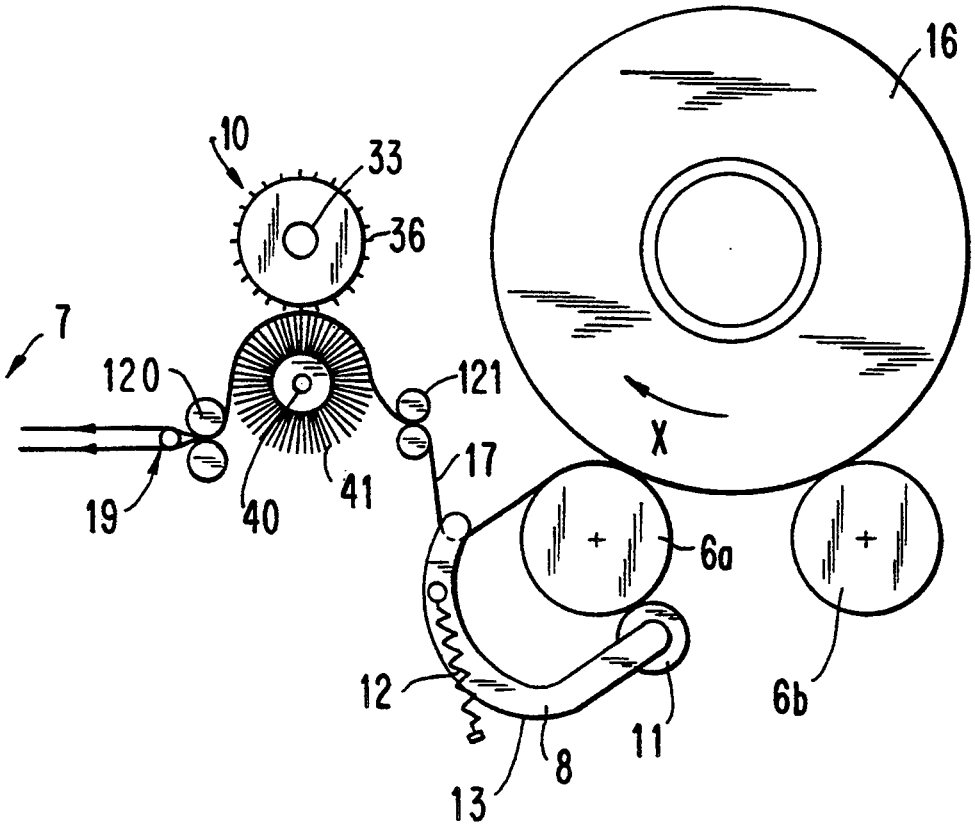
FIG. 9 is a cut-away side view of another embodiment of the present invention.

FIG. 9 is a cut-away side view of an alternate embodiment according to the present invention. A first pair of rollers 121 are disposed upstream of the rotary brush 41. A second pair of rollers 120 are disposed downstream of the rotary brush 41. The rollers 120, 121 are positioned so that they hold the film in tension along its entire length. Both pairs of rollers 120, 121 contain one-way clutches that allow the film to pass between them only in the downstream direction. Because the rollers 120, 121 do not permit the film to move upstream, a tension in the film is maintained. Due to the tension in the film, gripper wheels 34 are not required. Thus, microperforator pin wheels 36 can be mounted all the way across the microperforator shaft 33 to increase the number of pores punched in the film.

Thus, the present invention provides a method and apparatus for punching a vast number of minute pores in shrink film which are virtually invisible in the finished packaged item. The pores can exist along the entire length of the film surface thus permitting uniform air flow out of the package during the shrinking process. As a result, shrink-wrapped packages wrapped using the present invention are pleasing to the eye and protected from contamination.

The microperforator apparatus 10 of the present invention should be disposed along a film path between a film supply and a film pulling source. In the manual or semi-automatic L-sealer described above, the film supply is the roll of shrink-wrap film 16. The film pulling source is the operator who manually draws the film through the microperforator apparatus 10. Since the microperforator apparatus 10 is driven by drawing the film, the pins 37 move at the same rate as the film. This prevents the pins 37 from pulling or tearing the film during perforation.

Although described for use with a semi-automatic system, it will be appreciated that the microperforator apparatus 10 can be employed with other types of sealing apparatuses as well. For example, one skilled in the art could design a microperforator apparatus according to the present invention for use with an automatic heat-sealing system. Further, numerous other embodiments and variations of the invention will be apparent to those skilled in the art.

I claim:

1. A method for perforating shrink-wrap film as the film moves along a film path, comprising:

setting at least one microperforator means along a first shaft to punch a desired pattern of holes;

setting the lateral tension of the film by adjusting a plurality of gripper wheels connected to the first shaft;

threading the film between a biasing means connected to a second shaft and the microperforator means;

pulling the film to wrap an item such that the film passes between the biasing means and the microperforator means; and punching a plurality of pores in the film.

2. The method of claim 1, further comprising:

adjusting the first shaft so that different size pores will be punched.

3. The method of claim 1, further comprising:

adjusting the biasing means so that different size pores will be punched.

4. The method of claim 1, further comprising:

adjusting the microperforator means so that a different pattern of pores will be punched.

5. A perforating device for punching pores in shrink-wrap film as it moves along a film path, comprising:

a first housing;

a plurality of adjustable gripper wheels connected to a perforator shaft which is connected to the first housing, for creating lateral tension on the film between adjacent gripper wheels;

at least one microperforator means connected to the perforator shaft between adjacent gripper wheels and disposed along the film path; and a biasing means connected to a rotary shaft and disposed along the film path for biasing the shrink-wrap film into the microperforator means.

6. The perforating device of claim 5, wherein the microperforator means and the biasing means rotate in unison.

7. The perforating device of claim 5, wherein the biasing means is a rotary brush.

8. The apparatus of claim 5, further comprising:

a gearing means for connecting the perforator shaft and the rotary shaft.

9. The apparatus of claim 8, wherein the gearing means comprises:

a perforator gear connected to the perforator shaft; and a rotary gear connected to the rotary shaft, such that the perforator gear and the rotary gear contact each other during operation so that the rotary shaft and the perforator shaft turn in unison.

10. The apparatus of claim 5, further comprising:

adjustment means for changing the size of the pores by moving the biasing means either away from or towards the microperforator means.

11. The apparatus of claim 10, further comprising:

a fine adjusment means connected to the first housing for setting a limit for the distance between the microperforator means and the rotary brush means.

12. The apparatus of claim 5, wherein the microperforator means comprises a plurality of conical pins.

13. The apparatus of claim 12, wherein the conical pins are arranged in a diamond pattern.

14. The apparatus of claim 5, wherein the gripper wheels are made of PVC, polyurethane polyvinyl chloride.

15. The apparatus of claim 5, wherein the biasing means comprises:

a synthetic brush means connected to the rotary shaft.

16. The apparatus of claim 15, wherein the synthetic brush means is made of polyester.

17. The apparatus of claim 5, further comprising:

a safety cover connected to the first housing for preventing injury from the microperforator means.

* * * * *